United States Patent [19]

Walchuk

[11] 4,085,031

[45] Apr. 18, 1978

[54] COAL LIQUEFACTION WITH SUBSEQUENT BOTTOMS PYROLYSIS

[75] Inventor: George P. Walchuk, Queens, N.Y.

[73] Assignee: Exxon Research & Engineering Co., Linden, N.J.

[21] Appl. No.: 713,478

[22] Filed: Aug. 11, 1976

[51] Int. Cl.[2] ..... C10G 1/06

[52] U.S. Cl. ..... 208/8; 208/106; 208/127

[58] Field of Search ..... 208/8, 10, 50, 56, 106, 208/127

[56] References Cited

U.S. PATENT DOCUMENTS

| | | | |
|---|---|---|---|
| 3,018,242 | 1/1962 | Gorin | 208/10 |
| 3,188,179 | 6/1965 | Gorin | 208/10 |
| 3,717,570 | 2/1973 | Hochman et al. | 208/210 |
| 3,726,784 | 4/1973 | Correa et al. | 208/8 |
| 4,039,424 | 8/1977 | Hyde et al. | 208/8 |

*Primary Examiner*—Delbert E. Gantz
*Assistant Examiner*—James W. Hellwege
*Attorney, Agent, or Firm*—J. E. Reed; J. S. Finkle

[57] ABSTRACT

In a coal liquefaction process wherein heavy bottoms produced in a liquefaction zone are upgraded by coking or a similar pyrolysis step, pyrolysis liquids boiling in excess of about 1000° F. are further reacted with molecular hydrogen in a reaction zone external of the liquefaction zone, the resulting effluent is fractionated to produce one or more distillate fractions and a bottoms fraction, a portion of this bottoms fraction is recycled to the reaction zone, and the remaining portion of the bottoms fraction is recycled to the pyrolysis step.

11 Claims, 1 Drawing Figure

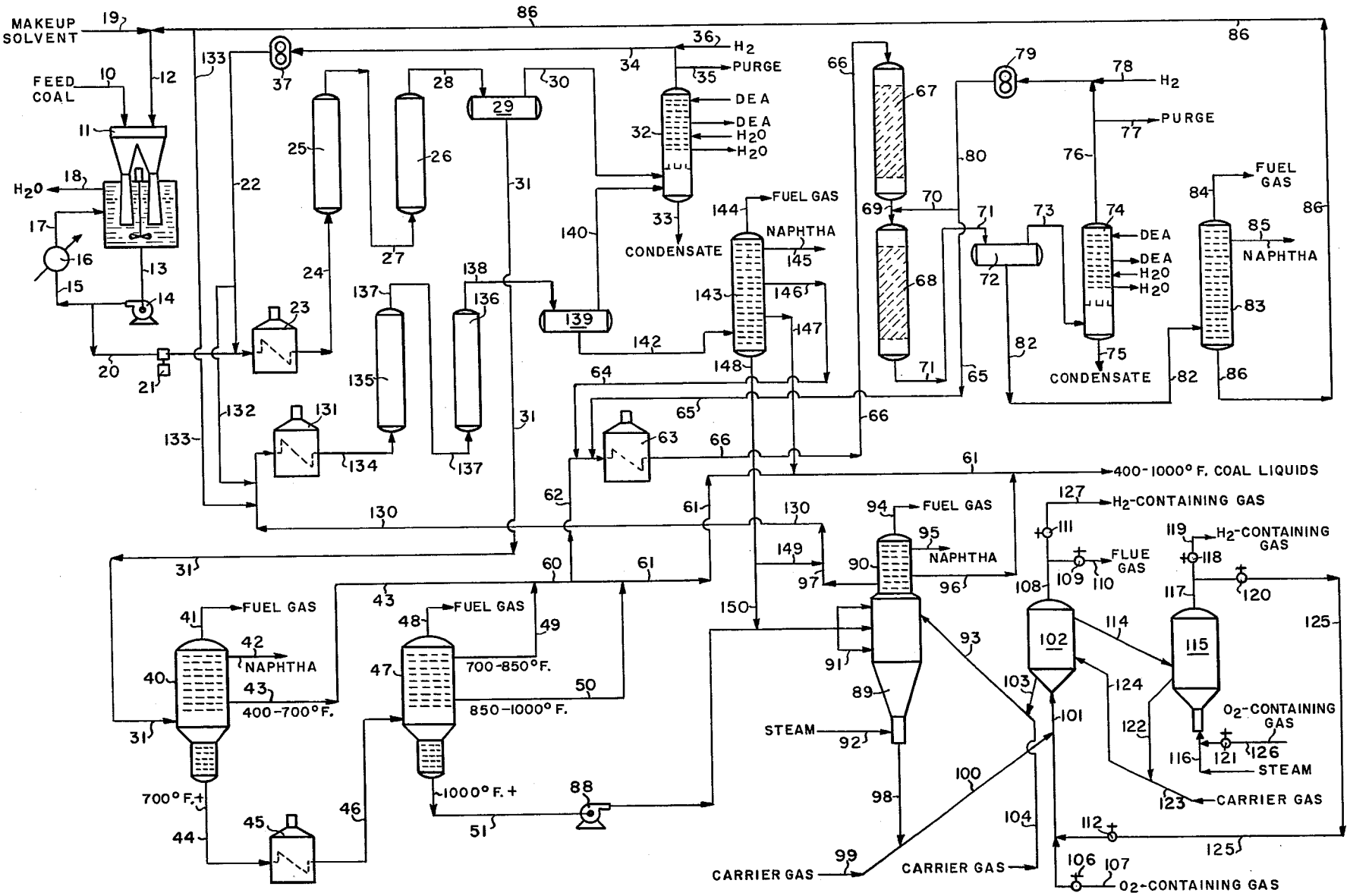
MAKEUP SOLVENT
FEED COAL
$H_2O$
$H_2$
PURGE
DEA
$H_2O$
FUEL GAS
NAPHTHA
CONDENSATE
400-1000° F. COAL LIQUIDS
$H_2$-CONTAINING GAS
FLUE GAS
$O_2$-CONTAINING GAS
STEAM
CARRIER GAS
700-850° F.
850-1000° F.
1000° F.+
400-700° F.
700° F.+

COAL LIQUEFACTION WITH SUBSEQUENT BOTTOMS PYROLYSIS

The Government of the United States of America has rights in this invention pursuant to Contract No. E(49-18)-2353 awarded by the U.S. Energy Research and Development Administration.

BACKGROUND OF THE INVENTION

1. Field of the Invention

This invention relates to the liquefaction of coal and similar carbonaceous solids and is particularly concerned with operations in which heavy bottoms produced by liquefaction are upgraded by pyrolysis.

2. Description of the Prior Art

Processes for the liquefaction of coal and similar carbonaceous solids normally involve contacting of the feed material with a hydrocarbon solvent and molecular hydrogen at elevated temperature and pressure. This results in partial breakdown of the complex high molecular weight starting material into lower molecular weight hydrocarbon liquids and gases. These are recovered from the liquefaction effluent, leaving a heavy liquefaction bottoms product which normally boils in excess of about 1000° F. and generally contains suspended solid residues. The liquefaction bottoms may constitute as much as about 50% by weight of the total liquefaction products.

A variety of different systems for upgrading liquefaction bottoms have been proposed in the past. Among the most attractive of these is pyrolysis of the bottoms to produce gases, additional hydrocarbon liquids, and coke, followed by steam gasification of the coke to form hydrogen for use in the liquefaction operation. Studies have shown that such an integrated process has many potential advantages over other processing systems, particularly if a catalyst is added to the coke to accelerate the gasification rate. One difficulty associated with such operations, however, is that the pyrolysis step results in the production of a heavy bottoms fraction which has a nominal boiling point in excess of about 1000° F. and a pour point of about 300° F. or higher and may contain up to about 3 weight percent of ash and other solids and in excess of about 1 weight percent sulfur. It has been suggested that this material be recycled to the liquefaction stage of the process but studies have shown that much of the recycled material passes through the liquefaction reactor with the bottoms and is returned to the pyrolysis unit. Here it is largely converted to coke and gas. At most only about 50% of the pyrolysis bottoms is converted to distillable liquid products and hence the efficiency of the operation suffers.

SUMMARY OF THE INVENTION

The present invention provides an improved process for the production of liquid and gaseous hydrocarbons from coal and similar liquefiable carbonaceous solids which at least in part obviates the difficulties pointed out above. In this improved process, heavy liquefaction bottoms produced by the treatment of coal or the like with molecular hydrogen and a hydrocarbon solvent under liquefaction conditions in a liquefaction zone are pyrolyzed in a fluid coker or other pyrolysis unit to produce gases, liquids nominally boiling below about 1000° F., pyrolysis bottoms having nominal boiling points in excess of about 1000° F., and coke. The pyrolysis bottoms are then fed to a reaction zone external of the liquefaction zone where they are contacted with molecular hydrogen, with or without a hydrocarbon solvent, under liquefaction conditions. Here the pyrolysis bottoms are hydrogenated to produce lower molecular weight liquid products and some gases. These are separated from the effluent from the reaction zone and the remaining unconverted high boiling material is for the most part recycled to the reaction zone. A small portion of this material is purged to eliminate ash from the system, preferably by recycling it as feed to the pyrolysis unit where essentially all of it will be converted into coke. This process results in substantially higher yields of liquid products boiling below about 1000° F. than are normally obtained in other processes, offers better control and allows optimization of operating conditions by separating the liquefaction step into two separate reactor systems, substantially eliminates difficulties otherwise encountered in handling refractory pyrolysis bottoms, and has other advantages over integrated coal liquefaction processes which have been employed in the past.

BRIEF DESCRIPTION OF THE DRAWING

The drawing is a schematic flow diagram of an integrated coal liquefaction process carried out in accordance with the invention.

DESCRIPTION OF THE PREFERRED EMBODIMENTS

The process illustrated in the drawing is one in which bituminous coal, subbituminous coal, lignite or other liquefiable carbonaceous solid feed material is liquefied by contacting the material with molecular hydrogen in the presence of a hydrogen-donor solvent and a heavy liquefaction bottoms product nominally boiling in excess of 1000° F. is obtained. This bottoms product is passed to an integrated fluid bed coking unit where a refractory coker scrubber liquid with a nominal 1000° F.+ boiling point is produced. The scrubber liquid or pyrolysis bottoms is fed to a second stage liquefaction unit where it is contacted with molecular hydrogen and solvent under liquefaction conditions. Following the separation of gases and lower boiling liquid products from the liquefaction effluent, unconverted heavy materials are in part recycled to the second stage liquefaction unit and in part returned to the coking unit in quantities sufficient to prevent the buildup of ash in the system. It will be understood that the process of the invention is not restricted to the particular type of liquefaction and pyrolysis units shown in the drawing and instead may be employed, for example, in liquefaction operations carried out in ebullating beds, operations conducted in the presence of liquefaction catalysts, operations which do not employ hydrogen-donor solvents, and operations in which gravity settling or similar means are employed for the removal of unreacted solids and ash from the liquefaction effluent. Similarly, the invention may be used in conjunction with delayed coking units or other pyrolysis systems in lieu of the integrated fluid bed coker shown in the drawing.

In the process depicted in the drawing, feed coal is introduced into the system through line 10 from a coal storage or feed preparation zone not shown and discharged into a slurry drying unit 11 where a slurry of the feed solids in a hydrogen-donor solvent introduced through line 12 is prepared. The feed coal employed will normally consist of solid particles of bituminous coal, subbituminous coal, lignite or a mixture of two or more such materials having a particle size on the order of about one-fourth inch or smaller along the major dimensions. It is generally preferred to employ coal which has been crushed and screened to a particle size of about 8 mesh or smaller on the U.S. Sieve Series Scale. The slurry drying unit will normally comprise an agitated drum in which the coal is suspended in hot hydrogen-donor solvent in a ratio of about 0.8 to about 2 pounds of solvent per pound of dry coal. The temperature in the unit is maintained between about 250° and about 350° F. by recycling a portion of the slurry withdrawn through line 13 by means of slurry pump 14. The recycle stream passes through line 15 and heat exchanger 16 and is reintroduced into the slurry dryer drum through line 17. Moisture present in the feed coal is vaporized at the drum temperature and withdrawn through line 18. This vapor steam will normally include some solvent vaporized along with the water and hence it will generally be passed through heat transfer equipment not shown in the drawing to condense the solvent and permit its recovery. It is normally preferred to operate the slurry dryer so that the water content of the slurry is maintained at a level below about 2% by weight.

The hydrogen-donor solvent used in preparing the slurry will normally be a coal-derived solvent, preferably a hydrogenated recycle solvent containing at least 20% by weight of compounds which are recognized as hydrogen donors at elevated temperatures of from about 700 ° to about 900° F. or higher. Solvents containing at least 50% by weight of such compounds are preferred. Representative compounds of this type include indane, $C_{10}$-$C_{12}$ tetrahydronaphthalenes, $C_{12}$ and $C_{13}$ acenaphthenes, di-, tetra- and octrahydroanthrecenes, tetrahydroacenaphthenes, crysene, phenanthrene, pyrene, and other derivatives of partially saturated aromatic hydrocarbons. Such solvents have been described in the literature and will be familiar to those skilled in the art. The solvent composition resulting from the hydrogenation of recycle solvent fractions produced in the process will depend in part upon the particular coal used as the feed stock, the process steps and operating conditions employed, and the conditions used in hydrogenating the solvent fraction selected for recycle following liquefaction. It is generally preferred that the solvent be mixed with the feed coal in a ratio of from about 1.0 to about 1.5 pounds of solvent per pound of dry coal. The solvent employed on initial startup of the process and any makeup solvent that may be required can be added to the system through line 19. During normal operations, the process produces an excess of liquid hydrocarbons in the solvent boiling range and hence the addition of makeup solvent is not ordinarily required.

The coal-solvent slurry not recycled to the slurry preparation drum is passed through line 20 and slurry pump 21 where the pressure is raised to the liquefaction pressure of about 1000 to about 3000 psig, preferably to between about 1500 and about 2500 psig. High pressure treat gas composed primarily of hydrogen but also including lesser quantities of carbon monoxide is introduced into the slurry downstream of the pump through line 22 in an amount sufficient to supply from about 1 to about 8 weight percent, preferably from about 2 to about 5 weight percent, of hydrogen on a moisture and ash-free coal basis. The resulting stream is then passed into mixed phase preheat furnace 23 where it is heated to a temperature within the range between about 750° F. and about 950° F. or higher. In lieu of this procedure, the treat gas can be separately preheated in a furnace not shown in the drawing and thereafter mixed with the hot slurry downstream of furnace 23.

The hot slurry containing suspended coal particles, hydrogen-donor solvent, and molecular hydrogen is passed through line 24 into the first of a series of liquefaction reactors 25 and 26. Although two upflow-type reactors are shown in the drawing, reactors of other types may be employed and in some cases it may be desirable to use a single reactor or provide three or more reactors. Reactors arranged in parallel instead of in series as shown can also be used in some cases. Within the liquefaction reactors, temperatures between about 750° and about 950° F. and pressures between about 1000 psig and about 3000 psig, preferably between about 1500 and about 2500 psig, are maintained. The liquid residence time within the two reactors, interconnected by line 27, will normally range between about 5 minutes and about 100 minutes, preferably between about 10 and about 60 minutes. Under these conditions, high molecular weight constituents of the feed coal are broken down and hydrogenated to form lower molecular weight gases, vapor, and liquid products. The liquid products will include heavy constituents having boiling points at atmospheric pressure in excess of about 1000° F. The hydrogen-donor solvent contributes hydrogen atoms which react with organic radicals liberated from the coal and prevent their recombination. Hydrogen in the treat gas injected into the slurry serves as replacement hydrogen for depleted hydrogen-donor molecules in the solvent and results in the formation of additional hydrogen-donor molecules by in situ hydrogenation. Some direct hydrogenation of coal radicals by hydrogen in the treat gas may also take place. The process conditions within the liquefaction zone are selected to insure the generation of sufficient hydrogen-donor precursors and at the same time provide sufficient liquid product for proper operation of the solvent hydrogenation zone to be described hereafter. These conditions may be varied as necessary.

The liquefaction reactor effluent is withdrawn from reactor 26 through line 28. This stream will normally include gaseous products such as carbon monoxide, carbon dioxide, ammonia, hydrogen, hydrogen chloride, hydrogen sulfide, methane, ethane, ethylene, propane, propylene and the like. It will also include solvent, coal liquids ranging from naphtha boiling range materials through heavy liquefaction products nominally boiling in excess of 1000° F., and entrained solids including unreacted coal and ash residues. This stream is passed from line 28 into liquefaction reactor effluent separator 29 where it is separated into an overhead vapor stream withdrawn through line 30 and a liquid stream taken off through line 31. Although only a single separator is shown, two or more separators may be provided. Heat exchanger equipment not depicted in the drawing will normally be included to permit the condensation of liquids and recovery of heat for the generation of steam to be used elsewhere in the system. The vapor stream withdrawn from separator 29 through line 30, after passage through heat recovery equipment not shown, is introduced into scrubbing unit 32 where the vapors are contacted with water and with an absorbent or solvent such as diethanolamine for the removal of hydrogen sulfide, carbon dioxide and other acid gas constituents in the conventional manner. Hydrocarbons condensed from the vapor are recovered as condensate through line 33 and gases are taken overhead through line 34. A portion of the gas stream will normally be purged through line 35 to prevent the buildup in the system of carbon monoxide, light hydrocarbons, and other contaminants in excessive quantities. Makup hydrogen is introduced into the gas stream through line 36, the gases are compressed sufficiently in compressor 37 to permit their recycle, and the high pressure stream is then passed through line 22 into the slurry being fed to the preheat furnace 23. It will be understood that the process is not restricted to the particular gas treating system shown and that separate scrubbers or similar equipment and solvents other than or in addition to diethanolamine can be employed if desired.

The liquids recovered from the liquefaction reactor effluent through line 31 are passed through pressure letdown valves and heat transfer equipment not shown in the drawing, and then fed into atmospheric fractionator 40. Here the liquid stream is fractionated to produce an overhead stream composed primarily of light hydrocarbon gases which is recovered through line 41, a naphtha stream boiling up to about 400° F. which is taken off through line 42, an intermediate liquid stream boiling between 400 and about 700° F., which is withdrawn through line 43, and a heavier fraction nominally boiling above about 700° F. which is withdrawn through line 44. Pumparound equipment, heat exchangers and other auxiliaries associated with the atmospheric fractionator are not shown. The overhead gases can be employed as fuel gas or used for other purposes. The naphtha stream may be withdrawn as product or alternatively combined with the intermediate boiling stream in line 43 and fed to the solvent hydrogenation unit as described hereafter. The heavier fraction recovered through line 44 is passed through vacuum fractionator preheat furnace 45 and then passed through line 46 into vacuum fractionator 47. The heavier fraction may alternatively be sent directly to vacuum fractionator 47 if desired.

In the vacuum fractionator, the liquids are further distilled under reduced pressure to produce an overhead fuel gas stream which is taken off through line 48, an intermediate fraction boiling between about 700 and about 850° F. which is passed through line 49 and combined with the 400° to 700° F. fraction from the atmospheric fractionator in line 43, a somewhat heavier fraction boiling between about 850° and about 1000° F. which is withdrawn through line 50, and a heavy bottoms fraction composed primarily of constituents nominally boiling in excess of about 1000° F. which is recovered through line 51. This heavy fraction is referred to as the liquefaction bottoms and in the process shown will generally include suspended particles of unreacted coal and ash residues. In other processes employing gravity separation, centrifuges or the like for the removal of such solids, the suspended particles may be present in somewhat lower concentrations. The liquefaction bottoms may constitute as much as 50% of the total effluent from the liquefaction stage of the process.

The nominal 400° to 700° F. fraction withdrawn from the atmospheric fractionator through line 43 and the 700° to 850° F. fraction from the vacuum fractionator in line 49 are combined in line 60. A portion of this liquid stream is combined with the nominal 850° to 1000° F. side stream from the vacuum fractionator in line 50 and passed through line 61 for withdrawal with products produced elsewhere in the system as 400° to 1000° F. coal liquids. The remaining 400° to 850° F. stream in line 60 is passed through line 62 to solvent hydrogenation preheat furnace 63. Heavy pyrolysis bottoms and recycle treat gas produced as described hereafter are added to the liquid feed prior to its introduction into the furnace through lines 64 and 65 respectively. Within the furnace, the feed stream including the pyrolysis bottoms and recycled gas is heated to the solvent hydrogenation temperature and then passed through line 66 to the first of a series of solvent hydrogenation reactors 67 and 68. These two reactors are interconnected by line 69 which may include one or more heat transfer units not shown in the drawing. The solvent hydrogenation reaction is an exothermic reaction and hence cooling or quenching is normally required to avoid excessive reaction temperatures, particularly in the second stage. Either liquid or gas quenching may be employed. Although two downflow fixed bed hydrogenation reactors are shown in the drawing, it will be understood that the process is not restricted to this particular hydrogenation reactor configuration and that in some cases a single stage unit or more than two stages may be advantageous.

The solvent hydrogenation unit will normally be operated at a pressure and temperature somewhat below those in the liquefaction unit. The temperature, pressure and space velocity employed for solvent hydrogenation will depend to some extent upon the composition of the feedstream to the unit, the catalyst employed, and other factors. In general, however, temperatures within the range between about 550° F. and about 850° F., pressures between about 800 psig and about 3000 psig, and space velocities within the range between about 0.3 and about 3 pounds of feed/hour/pound of catalyst are preferred. Hydrogen treat rates sufficient to give hydrogen partial pressures in the reactor between about 500 and about 2000 psig will ordinarily be employed. In the particular system shown, the hydrogen used in the first stage is introduced upstream of the preheat furnace through line 65 and additional hydrogen is supplied to the second stage through line 70 where it serves in part to quench the reaction in the second stage. It is normally advantageous to maintain a mean hydrogenation temperature in the solvent hydrogenation zone between about 675° F. and about 750° F., a pressure between about 2000 and about 2500° F., a liquid hourly space velocity between about 1 and about 2.5 pounds of feed/hour/pound of catalyst, and a hydrogen treat rate sufficient to give a hydrogen partial pressure between about 900 and about 1600 psig.

Any of a variety of conventional hydrotreating catalysts may be employed for purposes of the invention. Such catalysts typically comprise an alumina or silica-alumina support carrying one or more iron group metals and one or more meals from Group VI-b of the Periodic Table in the form of an oxide or sulfide. Combinations or two or more Group VI-B metal oxides or sulfides are generally preferred. Representative metal combinations which may be employed in such catalysts includes oxides and sulfides of cobalt-molybdenum, nickel-molybdenum-tungsten, cobalt-nickel-molybdenum, nickel-molybdenum, and the like. A suitable catalyst, for example, may be a high metal content sulfided cobalt-molybdenum-alumina catalyst containing from 1 to 10 weight percent of cobalt oxide and from about 5 to about 40 weight percent of molybdenum oxide, preferably from 2 to 5 weight percent of the cobalt oxide and from about 10 to about 30 weight percent of the molybdenum oxide. Other metal oxides and sulfides in addition to those specifically referred to above, particularly oxides of iron, nickel, chromium, tungsten and the like, can also be used. Numerous commercial hydrogenation catalysts suitable for use in the process of the invention are available from various catalyst manufacturers and will be familiar to those skilled in the art.

The reactions taking place in the solvent hydrogenation zone serve primarily to regenerate the hydrogen-donor solvent used for liquefaction purposes. The hydrogenated effluent is withdrawn from the second stage 68 of the solvent hydrogenation zone through line 71, passed through heat exchange equipment not shown in the drawing, and introduced into liquid gas separator 72. A vapor stream withdrawn from the separator through line 73 is introduced into scrubbing unit 74 where the vapor is contacted with water and a solvent or absorbent such as diethanolamine for the removal of hydrogen sulfide, ammonia, carbon dioxide and other acid gases. Hydrocarbons condensed in the scrubbing unit are recovered as condensate through line 75. The gases are taken overhead through line 76 and a portion of the gas stream is purged by means of line 77 to prevent the buildup of undesirable constituents within the system. The remaining gases are combined with makeup hydrogen introduced through line 78, raised to solvent hydrogenation pressure in compressor 79, and then recycled to the solvent hydrogenation zone through lines 80, 70 and 65. Again it will be understood that the process of the invention is not restricted to the particular procedure shown for treatment of the gases and that other procedures and different solvents may be employed if desired. Similarly, it will be understood that various heat exchangers and similar equipment which may be employed in the process are not shown in the schematic flow diagram depicted in the drawing.

The liquid portion of the solvent hydrogenation zone effluent is withdrawn from separator 72 through line 82 and, after suitable heat exchange in equipment not shown in the drawing, is introduced into solvent hydrogenation fractionator 83. Here the liquids are fractionated to produce an overhead stream taken off through line 84, a naphtha stream recovered through line 85, and a bottoms stream withdrawn through line 86. The overhead gases will be composed for the most part of hydrocarbon gases and can be employed as a fuel. The naphtha constitutes an additional product of the process. The high boiling material withdrawn as a bottoms stream through line 86 is a regenerated donor solvent having a nominal boiling range between about 400° and about 850° F. This stream is recycled through line 86 and line 12 to dryer 11 where it is employed for preparation of the coal-donor solvent slurry fed to the liquefaction unit.

The heavy liquefaction bottoms withdrawn from vacuum fractionator 47 through line 51 is passed by means of pump 88 to a fluidized bed coking unit 89. This unit will normally be provided with an upper scrubbing and fractionation section 90 from which liquid and gaseous products produced as a result of the coking reactions can be withdrawn. The unit will also generally include one or more internal cyclone separators or similar devices not shown in the drawing which serve to remove entrained particles from the upflowing gases and vapors entering the scrubbing and fractionation section and return them to the fluidized bed below. A plurality of feed lines 91 will ordinarily be provided to obtain better distribution of the feed material within the coking unit.

The reaction section of the fluidized bed coking unit shown in the drawing contains a bed of coke particles which are maintained in the fluidized state by means of steam or other fluidizing gas introduced near the bottom of the unit through line 92. This fluidized bed is normally maintained at a temperature between about 900° F. and about 1300° F. by means of hot char which is introduced into the upper part of the reaction section through line 93. The pressure within the reaction zone will generally range between about 10 and about 30 pounds per square inch gauge but higher pressures can be employed if desired. The optimum conditions in the reaction zone will depend in part on the characteristics of the particular feed material employed and can readily be determined.

The hot liquefaction bottoms is fed into the reaction zone of the coking unit through feed lines 91 and sprayed onto the surfaces of the coke particles in the fluidized bed. Here it is rapidly heated to bed temperatures. As the temperature of the bottoms increases, lower boiling constituents are vaporized and the heavier portions undergo thermal cracking and other reactions to form lighter products and additional coke on the surfaces of the bed particles. Vaporized products, unreacted steam, and entrained solids remove upwardly through the fluidized bed and into the cyclone separators or similar devices where solids present in the fluids are rejected. The fluids then move into the scrubbing and fractionation section of the unit where refluxing takes place. An overhead gas stream is withdrawn from the coker through line 94 and may be employed as a fuel gas or the like. A naphtha stream is taken off through line 95 and can be combined with naphtha produced at other stages in the process. A heavier liquids fraction having a nominal boiling range between about 400° and about 1000° F. is withdrawn as a side stream through line 96 and combined with coal liquids in line 61 for withdrawal from the system. A heavier pyrolysis bottoms stream having a nominal boiling range above about 1000° F. is withdrawn from the coking unit through line 97 for further processing as described hereafter.

The coke particles in the fluidized bed of the coker reaction section tend to increase in size as additional coke is deposited. These particles thus gradually move downwardly through the fluidized bed and are eventually withdrawn from the reaction section through line 98 as a dense phase solids stream. This stream is picked up by steam or other carrier gas introduced through line 99 and transported upwardly through lines 100 and 101 into fluidized bed heater 102. Here the coke particles in the fluidized bed of the heater are heated to a temperature of from about 100° to about 300° F. above that in the reaction section of the coker. Hot solids are withdrawn from the bed of heater 102 through standpipe 103, picked up by steam or other carrier gas introduced through line 104, and returned to the reaction section of the coker through line 93. The circulation rate between the coker and the heater is thus maintained sufficiently high to provide the heat necessary to keep the coker at the required temperature. The solids within the heater can either be heated directly by the introduction of air or oxygen or by the passage of hot gases from an associated gasifier as described below.

If the solids in heater 102 are to be heated by the direct injection of air or oxygen-containing gas, valve 106 in line 107 will be opened and the air or oxygen-containing gas required will be passed upwardly through line 101 into the bottom of the heater. Flue gases taken overhead from the heater through line 108 will be passed through valve 109 and line 110 for the removal of solids and contaminants prior to discharge of the gases into the atmosphere or their use for other purposes. In this mode of operation, valves 111 and 112 are normally closed.

The coking unit shown in the drawing includes an associated gasifier for the gasification of coke particles to produce a hydrogen-containing gas. Alternatively, the gasifier may be omitted, the coke being sent directly to another type of hydrogen generation facility, such as a fixed bed catalytic or non-catalytic system, if desired. In the particular case shown, hot carbonaceous particles are continuously circulated from the fluidized bed in heater 102 through line 114 to the fluidized bed gasifier 115. Here the coke particles are contacted with steam introduced into the lower end of the gasifier through line 116. The hot coke particles are gasified by the steam to produce a gas containing hydrogen, carbon monoxide, carbon dioxide and some methane. This gas is taken overhead from the gasifier through line 117, passed through valve 118, and discharged through line 119 to downstream upgrading equipment where the gas may be shifted over a shift catalyst to increase the ratio of hydrogen to carbon monoxide, where acid gases may be removed, and where the residual carbon monoxide may be catalytically methanated to produce a high purity hydrogen stream suitable for use as makeup hydrogen for the liquefaction and solvent hydrogenation steps of the process. Conventional shift, acid gas removal, and methanation procedures can be employed. In this mode of operation, valves 120 and 121 are normally closed.

A stream of hot carbonaceous solids is continuously withdrawn from the gasifier through standpipe 122, entrained in steam, flue gas or other carrier gas introduced through line 123, and returned to heater 102 through line 124. The solids circulation rate between the heater and gasifier is adjusted to maintain a gasifier temperature within the range between about 1300° and about 1900° F. It is generally preferred to operate the coking unit at a temperature between about 900 and about 1300° F. and to operate the fluidized bed heater at a temperature of from about 1000° to about 1600° F. It is generally preferred to operate the gasifier at a temperature between about 1500° and 1800° F. A gasification catalyst can be employed in the gasifier to accelerate the gasification rate if desired. Suitable catalysts include alkali metal compounds such as potassium carbonate and potassium hydroxide and alkaline earth metal compounds such as calcium hydroxide, barium acetate, strontium carbonate and the like. The alkali metal compounds used as catalysts can be introduced into the gasifier itself or added upstream of the gasifier. The alkaline earth metals compounds are preferably added to the liquefaction bottoms upstream of the coking unit but in some cases can be incorporated at other points in the system.

In lieu of introducing air or an oxygen-containing gas into the fluidized bed heater through line 107 as described above, hot gases taken overhead from the gasifier through line 117 can be passed through valve 120, line 125, valve 112 and line 101 to the heater. In this case, valves 106 and 118 will normally be closed. Air or oxygen-containing gas is introduced into the system through line 126 and passed into the gasifier through line 116 with the steam employed for gasification purposes. The amount of air or oxygen-containing gas thus provided is adjusted so that required gasification temperatures in gasifier 115 are maintained. The hot gases passing from the gasifer to the fluidized bed heater transfer heat to the solid particles within the heater and maintain them at the required temperature level. The gas taken overhead from the heater in this case will include the gasification products. This stream, assuming that oxygen rather than air is injected into the lower end of the gasifier with the steam used for gasification purposes, will consist primarily of hydrogen, carbon monoxide, carbon dioxide, and some steam. These gases are taken overhead from the heater through line 108, valve 111 and line 127. Valve 109 is normally closed. The gases thus withdrawn will generally be passed to downstream gas upgrading equipment for shifting of the gas, removal of acid gases, and methanation of the residual carbon monoxide by conventional procedures to produce a high purity hydrogen stream. This hydrogen can then be compressed and employed in the liquefaction and solvent hydrogenation steps of the process. If desired, additional hydrogen can be produced by the steam reforming of a part or all of the fuel gas generated in the process. Following such a steam reforming step, the resultant gases can be processed for the recovery of a high purity hydrogen stream in much the same manner as the gases produced in the steam gasification step of the process.

The pyrolysis bottoms withdrawn from the stripping and fractionation section 90 of the coking unit through line 97 is a refractory material with a nominal boiling point in excess of 1000° F. which will generally contain up to about 3 weight percent of ash and solids and 1% or more of sulfur. It will generally have a pour point of about 300° F. or higher. If this material is recycled to the liquefaction step of the process, it will normally pass through with the liquefaction bottoms and be returned to the coking unit where it is largely converted to coke and light hydrocarbon gases. At most, only about 50% of the material can be upgraded into more valuable products boiling below about 1000° F. In the process of this invention, the pyrolysis bottoms withdrawn through line 97 is fed through line 130 to a secondary liquefaction preheat furnace 131. Hydrogen-containing gas withdrawn from line 22 through line 132 is added to the bottoms stream in line 130 prior to introduction of this stream into the furnace. Alternatively, the gas can be preheated in a separate furnace not shown in the drawing and then introduced into the hot bottoms stream emerging from the furnace. The hydrogen-containing gas will normally be introduced into the pyrolysis bottoms in an amount sufficient to supply from about 1 to about 10 weight percent, preferably from about 2 to about 6 weight percent of molecular hydrogen based on the weight of the bottoms. Solvent withdrawn from line 86 through line 133 may also be added to the bottoms stream before it is fed to the furnace. It is generally preferred to add from about 0.5 to about 2.0 pounds of solvent per pound of pyrolysis bottoms but the addition of solvent is not essential and in some cases the process can be operated without adding solvent to the bottoms at this point. The pyrolysis bottoms and treat gas, with or without additional solvent, is heated in furnace 131 to a liquefaction temperature between about 750° and about 950° F. This hot stream is then passed through line 134 into the first of a series of secondary liquefaction reactors 135 and 136. In the drawing, two upflow reactors interconnected in series by line 137 are shown but a single reactor or three or more reactors connected in either series or parallel may be used if desired.

Within the secondary liquefaction reactor or reactors, the molecular hydrogen in the treat gas reacts with the pyrolysis bottoms at a temperature between about 750° and about 950° F. and at a pressure between about 1000 and about 3000 psig, preferably between about 1500 and about 2500 psig, to form lower boiling liquid hydrocarbons and some gases. Sulfur present in the pyrolysis bottoms is in large part converted to hydrogen sulfide. If hydrogen-donor solvent is present, the solvent contributes hydrogen atoms which react with organic radicals liberated from the bottoms and molecular hydrogen in the treat serves as replacement hydrogen for the depleted hydrogen-donor molecules in the solvent. Studies indicate that as much as 90% of the bottoms stream can thus be upgraded into lower boiling products which have nominal boiling points below 1000° F. and are relatively free of ash and sulfur contaminants. Residence times within the secondary liquefaction zone will normally range between about 5 minutes and about 100 minutes and will preferably be between about 10 and about 60 minutes. The amount of conversion which takes place within this zone will depend in part upon the operating conditions employed and the nature of the pyrolysis bottoms product fed to the zone. The process conditions within the secondary liquefaction zone can be altered as desired to produce maximum conversion into lower boiling liquid products of enhanced value.

The liquefaction effluent from the secondary liquefaction zone is withdrawn through line 138 and passed to secondary liquefaction effluent separator 139 where it is separated into liquid and gaseous components. Although a single separator is shown, two or more separators operating at different conditions may be employed. Various heat exchangers which will generally be used are not shown in the drawing. The gases and vapors are removed overhead from separator 139 through line 140 and passed to scrubbing unit 132 where hydrogen sulfide, carbon dioxide and other acid gas constituents are removed, hydrocarbons condensed from the vapor are recovered, and hydrogen-containing gas is taken overhead with gases of similar composition recovered from the effluent from the main liquefaction reactors 25 and 26.

The liquid stream withdrawn from separator 139 through line 142 is passed to a vacuum flash or fractionation tower 143 where it is distilled for the recovery overhead of fuel gases through line 144, naphtha through line 145, and one or more heavier distillate fractions normally boiling between about 400° F. and about 1000° F. In the installation shown in the drawing, a lighter distillate fraction boiling between about 400° F. and about 750° F. is taken off through line 146 and passed through line 64 to the feed stream introduced into the solvent hydrogenation preheat furnace 63. A heavier distillate fraction nominally boiling between about 750° F. and about 1000° F. is withdrawn through line 147 and passed to the products stream in line 61 for withdrawal as 400° to 1000° F. coal liquids. A bottoms stream containing unconverted pyrolysis bottoms and residues remaining from the conversion of bottoms to lighter products is withdrawn from fractionation zone 143 through line 148. The major portion of this bottoms stream is introduced through line 149 into the pyrolysis bottoms stream being passed through line 130 to the secondary liquefaction preheat furnace 131. From about 3 to about 10% of this bottoms stream is passed through line 150 for return to the coking unit with the liquefaction bottoms introduced through feed lines 91. This material is largely converted into coke and gases in the coking unit. In lieu of recycling this stream to the coker, it can be purged from the system to eliminate the ash and other contaminants if desired.

Although the process of the invention has been described above in terms of the use of a secondary liquefaction unit similar to the main liquefaction unit, it will be understood that other equipment for the hydrogenation of the pyrolysis bottoms can be employed if desired. The pyrolysis bottoms can be hydrogenated, for example, in a fixed or moving bed containing a sulfur-resistant hydrogenation catalyst typically comprising an alumina or silica-alumina support carrying one or more iron group metals and one or more metals from Group VI-B of the Periodic Table in the form of an oxide or sulfide, and similar or identical to a standard hydrogenation catalyst as described previously. Alternatively, if desired, the pyrolysis bottoms can be hydrocracked in a conventional or modified hydrocracker using a suitable hydrocracking catalyst typically, but not necessarily, comprising an intimate physical mixture of ion-exchanged and decationized molecular sieve containing palladium or a similar metal on an alumina or silica-alumina support to produce lower molecular weight, distillable liquid products. Other modifications of the process shown in the drawing can be made without departing from the invention and will be apparent to those skilled in the art.

I claim:

1. In a process for the production of liquid hydrocarbons from coal or similar liquefiable carbonaceous solids wherein said solids are reacted with hydrogen under liquefaction conditions in a first liquefaction zone, a high boiling liquefaction bottoms stream composed primarily of constituents nominally boiling in excess of about 1000° F. is separated from the first liquefaction zone effluent, at least part of said liquefaction bottoms stream is pyrolyzed in a pyrolysis zone, and gases, liquids nominally boiling below about 1000° F., a high boiling pyrolysis bottoms stream boiling in excess of about 1000° F., and coke are recovered from the pyrolysis zone, the improvement which comprises reacting at least a portion of said pyrolysis zone, the improvement which comprises reacting at least a portion of said pyrolysis bottoms stream with hydrogen in the presence of a solvent under liquefaction conditions in a second liquefaction zone external of said first liquefaction zone.

2. A process as defined by claim 1 wherein said pyrolysis zone is a fluid coking zone.

3. A process as defined by claim 1 wherein the effluent from said second liquefaction zone is fractionated and a high boiling fraction separated from the second liquefaction zone effluent is in part recycled to said second liquefaction zone.

4. A process as defined by claim 1 wherein said pyrolysis bottoms stream is reacted with hydrogen in said second liquefaction zone at a temperature between about 750 and about 950° F. and at a pressure between about 1000 and about 3000 psig.

5. A process as defined by claim 1 wherein the effluent from said second liquefaction zone is fractionated to produce a high boiling fraction boiling in excess of about 1000° F., a major portion of said high boiling fraction is recycled to said second liquefaction zone, and a minor portion of said high boiling fraction is recycled to said pyrolysis zone.

6. A process as defined by claim 1 wherein the effluent from said second liquefaction zone is separated into a vaporous stream and a liquids stream, said vaporous stream is treated for the removal of contaminants and in part recycled as treat gas to said second liquefaction zone and said liquids stream is fractionated and in part recycled to said second liquefaction zone.

7. A process as defined by claim 5 wherein from about 3 to about 10% of said high boiling fraction is recycled to said pyrolysis zone.

8. A coal liquefaction process which comprises reacting feed coal with molecular hydrogen in the presence of a hydrogen-donor solvent at elevated temperature and pressure in a first liquefaction zone, recovering a high boiling liquefaction bottoms stream composed primarily of constituents nominally boiling in excess of about 1000° F. from the effluent from said first liquefaction zone, pyrolyzing at least part of said liquefaction bottoms stream in a coking zone, recovering gases, liquids nominally boiling below about 1000° F., a high boiling pyrolysis bottoms stream nominally boiling in excess of about 1000° F., and coke from the coking zone, reacting at least part of said pyrolysis bottoms stream with molecular hydrogen in the presence of a hydrogen-donor solvent at elevated temperature and pressure in a second liquefaction zone, fractionating the effluent from said second liquefaction zone to produce distillable liquid products and a heavier fraction, and recycling at least part of said heavier fraction to said second liquefaction zone.

9. A process as defined by claim 8 wherein a part of said heavier fraction is recycled to said coking zone.

10. A process as defined by claim 8 wherein said coking zone is a fluid coking zone and coke produced in said coking zone is gasified to produce a hydrogen-rich gas.

11. In a process for the production of liquid hydrocarbons from coal or similar liquefiable carbonaceous solids wherein said solids are reacted with hydrogen under liquefaction conditions in a first liquefaction zone, a high boiling liquefaction bottoms stream is separated from the first liquefaction zone effluent, at least part of said liquefaction bottoms stream is pyrolyzed in a pyrolysis zone, and a high boiling pyrolysis bottoms stream is recovered from the pyrolysis products, the improvement which comprises reacting at least a portion of said pyrolysis bottoms stream with hydrogen in the presence of a hydrogen-donor solvent at elevated temperature and pressure in a second liquefaction zone external of said first liquefaction zone.

* * * * *

UNITED STATES PATENT OFFICE

CERTIFICATE OF CORRECTION

Patent No. 4,085,031 Dated April 18, 1978

Inventor(s) George P. Walchuk

It is certified that error appears in the above-identified patent and that said Letters Patent are hereby corrected as shown below:

Claim 1, line 45, cancel beginning with "the improvement" to and including "pyrolysis zone," in claim 1, line 46.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*